United States Patent [19]

Schippers et al.

[11] 4,330,987

[45] May 25, 1982

[54] MULTI-SPINDLE DOUBLE TWIST TWISTING MACHINE

[75] Inventors: Heinz Schippers; Karl-Heinz Rehn; Klaus Weber, all of Remscheid; Heinz Middelmann; Karl-Heinz Schulte, both of Radevormwald, all of Fed. Rep. of Germany

[73] Assignee: Barmag Barmer Maschinenfabrik A.G., Remscheid, Fed. Rep. of Germany

[21] Appl. No.: 161,393

[22] Filed: Jun. 20, 1980

[30] Foreign Application Priority Data

| | | | |
|---|---|---|---|
| Jun. 26, 1979 | [DE] | Fed. Rep. of Germany | 2925643 |
| Jun. 26, 1979 | [DE] | Fed. Rep. of Germany | 2925644 |
| Jun. 26, 1979 | [DE] | Fed. Rep. of Germany | 2925668 |
| Jun. 26, 1979 | [DE] | Fed. Rep. of Germany | 2925697 |
| Jun. 28, 1979 | [DE] | Fed. Rep. of Germany | 7918471[U] |

[51] Int. Cl.[3] ..... D01H 1/16; D01H 1/18

[52] U.S. Cl. ..... 57/1 R; 57/104

[58] Field of Search ..... 57/1 R, 58.49, 92, 104, 57/105, 130, 136, 352

[56] References Cited

U.S. PATENT DOCUMENTS

| | | | |
|---|---|---|---|
| 2,923,119 | 2/1960 | Nifenecker | 57/1 R |
| 3,641,757 | 2/1972 | Rehn | 57/105 X |
| 3,782,087 | 1/1974 | Frawzen et al. | 57/1 R |
| 3,936,995 | 2/1976 | Laflaquiere et al. | 57/1 R |
| 4,036,000 | 7/1977 | Grieve | 57/1 R |

*Primary Examiner*—Donald Watkins

*Attorney, Agent, or Firm*—Richards, Shefte & Pinckney

[57] ABSTRACT

A multi-spindle double twist twisting machine having a spindle frame in the form of a support plate that serves as a self-supporting sub-frame mountable alternatively in either a vertical or horizontal spindle machine and on which a plurality of spindle assembly mounting means are supported in two staggered rows. The support plate has side flanges to facilitate forming an enclosure around spindle assembly whorls and a belt drive assembly. A separator wall is mounted on the support plate between the rows of spindle assemblies and has ballooning yarn guides mounted thereon and extending over the spindle assemblies. The wall is extendable to adjust for yarn package sizes and operating conditions. The support plate may be formed in two portions with adjacent flanges for attaching the portions together and the wall may have an attaching flange for positioning between the adjacent flanges of the support plate portions to form an integral independent sub-frame. The spindle assembly mounting means is disposed on the support plate to provide a space at the end of each row, preferably at one end of the support plate beyond one row and at the opposite end of the support plate beyond the other row. Receivers for storage of spindle assembly heads are mounted in these spaces. The spindle assemblies are formed with discs having segments provided thereon for mounting of magnet means or weights to resist rotation of the yarn package from which yarn is withdrawn into the twisting operation.

35 Claims, 14 Drawing Figures

MULTI-SPINDLE DOUBLE TWIST TWISTING MACHINE

BACKGROUND OF THE INVENTION

The present invention relates to multi-spindle double twist twisting machines and more particularly to a spindle frame therefor and related belt drive assembly and spindle assembly.

Multi-spindle double twist twisting machines have been well-known and in commercial use for many years. There are two basic types of such machines, the one in longest prior use being the type with the axes of the spindle assemblies being arranged in vertical disposition, and the more recent type being that in which the spindle assemblies are arranged with their axes in horizontal disposition. An example of the latter is disclosed in Barmag (Rehn) U.S. Pat. No. 3,641,757, issued Feb. 15, 1972.

In the conventional vertical spindle machines there are usually two parallel rows of spindle assemblies extending from a common level, whereas in the horizontal spindle machines there are usually two rows of spindle assemblies on each side of the machine, which is of particular advantage in that a greater number of spindles in the same floor space is possible in comparison with a vertical spindle machine and the spindle assemblies are more assessable than in the vertical spindle machine. Also, the noise factor is reduced in a horizontal spindle machine. Thus, the horizontal spindle machine has efficiency and operational advantages over the vertical spindle machine, but the vertical machine may be made in a simple construction with less investment for smaller capacities and is less complicated in operation. As a result, both the horizontal spindle and the vertical spindle machines have commercial significance and are in common use.

At the present time, a manufacturer interested in supplying machines for both the horizontal spindle and the vertical spindle markets must manufacture machines of both types, with a commensurate high manufacturing, inventory and parts costs. In this regard, one of the more expensive items in the manufacture of a double twist twisting machine is the spindle frame, which includes a support plate on which spindle assembly mounting means are mounted for support of spindle assemblies that carry the yarn packages from which yarn is withdrawn during operation of the machine. In the past it has been necessary to manufacture and inventory different parts for the spindle frames of the vertical and horizontal machines. In contrast, according to the primary feature of the present invention, a spindle frame is constructed that is universally applicable to both horizontal spindle machines and vertical spindle machines so that only one type need be manufactured and stored, and production does not have to be closely related to specific customer orders but can be conveniently and more cheaply handled.

Another important component of double twist twisting machines, particularly vertical machines, is a separator wall that is disposed between the rows of spindle assemblies to prevent tangling of yarns from one spindle assembly with the yarns from a spindle assembly in the adjacent row when one of the yarns breaks. Different separator walls are conventionally utilized for different varieties of machines, and previously have not been commonly used in horizontal spindle machines. Thus the separator wall has been another obstacle for the manufacture of a universally applicable spindle frame, particularly for manufacturers who produce both horizontal and vertical spindle machines. In contrast, the present invention provides a separator wall construction that can be universally used in either the horizontal or the vertical spindle type machine and conveniently can be incorporated in a spindle frame construction as an integral part thereof for use in either type of machine. Furthermore, this separator wall has an adjustability capability in combination with support of ballooning yarn guides to provide more efficient operation with a minimum obstruction to access to the spindle assemblies for package replacement and also for spindle assembly maintenance.

In both the horizontal spindle and vertical spindle machines, belt drive assemblies are utilized to drive the spindle assemblies by belt engagement with whorls on the spindle assemblies and, because of this relationship, spindle frames have been conventionally designed and constructed for at least partial mounting support of the belt drive assembly, which has required different spindle frame designs for the different machines. In contrast, the present invention involves a spindle frame construction that is independent of the belt drive assembly, which is otherwise mounted on the machine so that a common spindle assembly construction can be used on machines having different types of belt drive assemblies. This independence of the spindle frame from the belt drive assembly also facilitates production and inventorying of parts.

Another difference between some conventional horizontal spindle machines and vertical spindle machines is in the provision in the spindle assembly to resist possible rotation of the yarn package during operation. In a typical vertical spindle machine a magnet is attached to a disc on the spindle assembly for attraction to another magnet mounted on the machine frame, whereas in a typical horizontal spindle machine a weight is mounted on the spindle assembly at an offset from the axis to resist rotation about the horizontal axis of the spindle. Thus different spindle assembly components have been required to accommodate these different means of resisting rotation. In contrast, the present invention provides a spindle assembly component that will accommodate either a magnet or a weight and can, therefore, be utilized either in a horizontal spindle or a vertical spindle machine, providing the same type of manufacturing and inventorying advantages as the spindle frame of the present invention.

SUMMARY OF THE INVENTION

The present invention provides a spindle frame for supporting a plurality of spindle assemblies in multi-spindle double twist twisting machines of the type having vertical frame stands at the ends of the sections of the machine. The spindle frame comprises a support plate formed for mounting spindle assemblies thereon and particularly includes a plurality of spindle assembly mounting means on the plate for mounting spindle assemblies with whorl portions of the spindle assemblies projecting in freestanding arrangement from one side of the plate and yarn supporting portions of the spindle assemblies projecting in freestanding arrangement from the other side of the plate. The support plate is formed with longitudinal ends for mounting of the plate in the vertical frame stands at the ends of a machine section without intermediate support as a self-supporting subframe that is uniquely mountable alternatively in either a machine of the type in which the spindle assemblies are disposed with their axes vertical or a machine of the type in which the spindle assemblies are disposed with their axes horizontal.

Preferably the spindle frame is provided with two longitudinal rows of spindle assembly mounting means so that a spindle frame can be mounted on each side of a horizontal spindle machine for disposition of two rows of spindle assemblies on each side of the machine or one spindle frame can be utilized to support two rows of spindle assemblies in a vertical spindle machine. The spindle assembly mounting means in one row are preferably staggered with respect to the spindle assembly mounting means in the other row of the spindle frame, as aforementioned, so that when the spindle frame is used in a horizontal spindle machine that yarn take-off from one spindle assembly will not interfere with any adjacent spindle assembly in the other row and also uniquely allowing for aligned alternate yarn ballooning guides to be used on a common separator wall, as described below, when the spindle frame is used in a vertical spindle machine as well as in a horizontal spindle machine. Heretofore, such a staggered spindle assembly arrangement in a double row vertical spindle machine has not been utilized or contemplated.

Although having the spindle assembly mounting means in one row staggered with respect to the spindle assembly mounting means in the other row of a two row spindle frame is an advantageous capability of the spindle frame of the present invention, there are instances where it may be preferred that the spindle assembly mounting means be aligned rather than staggered, and a significant feature of one form of the present invention is the capability of using the same spindle frame components in a staggered spindle assembly arrangement or alternatively in an aligned spindle assembly arrangement without having to manufacture and inventory separate components for each arrangement. This is accomplished by forming the aforementioned support plate with two longitudinally extending plate portions, each portion having one row of spindle assembly mounting means thereon and the plate portions attached to each other along adjacent longitudinal edges thereof to form an integral support plate. With this feature, a single plate portion construction can be utilized for both portions and by locating the spindle assembly mounting means offset toward one end of the plate portion two identical portions can be attached together with their offsets aligned to form a spindle frame with an aligned spindle assembly arrangement or alternatively either of the identical plate portions can be reversed to locate the respective offsets at opposite ends of the spindle frame to provide the staggered spindle assembly arrangement.

In the preferred embodiment, the support plate is provided with side flanges projecting from the longitudinal edges thereof in the direction of projection of the spindle assembly whorl portions to provide sides to the spindle frame for rigidifying the frame and for attachment of enclosure plates thereto that can form an enclosure to reduce noise. In addition, flanges, similar to the side flanges, preferably are provided centrally of the support plate by forming the support plate in two longitudinally extending plate portions as aforementioned, each portion having one row of the spindle assembly mounting means thereof, and each having a perpendicularly projecting flange along the longitudinal edge thereof adjacent the other plate portion and connected to the corresponding flange of the other plate portion for attachment of the plate portions to form an integral support plate. This flange attachment feature is particularly advantageous when the aforementioned alternative attachment feature is utilized as the flanges along both longitudinal edges of each plate portion provide adjacent attaching flanges on the plate portions both in either of the alternative aligned or staggered spindle assembly arrangement using identical plate portions. Further, this flange attachment feature is advantageous when the spindle frame includes a separator wall along the longitudinal center line thereof as the separator wall may be formed with an attaching flange projecting therefrom between the adjacent support plate portion flanges and secured to and between said flanges to conveniently form the separator wall as an integral portion of the spindle frame.

The aforementioned separator wall, which may be secured to and between the support plate portion edges or otherwise secured to a support plate, projects perpendicularly from the support plate along the longitudinal center line thereof on the side from which the spindle assembly yarn supporting portions project to provide separation of the spindle assemblies in one row from those in the other and thereby prevent entanglement or other interference by a broken yarn from one spindle assembly with the yarn of a spindle assembly in the other row. Importantly, this integral incorporation of the separator wall in the support plate provides a spindle frame complete with separator wall that is capable of utilization in either a vertical or horizontal spindle machine.

For further universal utilization of a single spindle frame in various machines and under different operating conditions, the separator wall is made to be extendable perpendicularly of the support, thereby allowing adjustment of the projecting extent of the separator wall to provide necessary separation with different size yarn packages and under different operating conditions and yet allowing adjustment to the least projecting extent necessary so as to minimize obstruction to access to the spindle frames and yarn packages. This separator wall extension, in one form of the invention, is provided by having an inner base portion of the separator wall secured to the support plate and an outer adjustable portion mounted on the inner base portion for adjustable positioning, preferably in telescoping relation, with respect thereto for adjustment of the extent of the separator wall perpendicular to the support plate. This separator wall adjustment also importantly allows for mounting of ballooning yarn guides on the adjustable outer portion of the separator wall for extendable adjustment therewith and projecting therefrom beyond the spindle assemblies for guiding therethrough of yarn ballooning from the spindle assemblies. Thus the adjustment of the separator wall extent provides simultaneous and corresponding adjustment of all of the guides. Means are provided for adjustably extending the separator wall, which may be in the form of at least one stationary threaded sleeve projecting between the rows of spindle assemblies, an outer wall portion, and a threaded rod secured to the outer wall portion and threadably engaged in the sleeve for threadable extension of the rod and outer wall portion with respect to the spindle frame. When the separator wall has a stationary inner base portion, the threaded sleeve is disposed for projection within the inner base portion. It should be understood, that these features of the separator wall, while preferably being utilized in conjunction with a spindle frame of the type capable of alternative use in a vertical spindle machine and a horizontal spindle machine, has inventive application as well independently of the alternative spindle frame mounting feature.

The aforementioned staggered relation of the spindle assembly mounting means is accomplished by having the spindle assembly mounting means in both rows equally spaced and with the spindle assembly mounting means in one row staggered with respect to the spindle assembly mounting means in the other row at a spacing of approximately one half the spacing between the centers of spindle assemblies. This will provide a spacing between one end of each row and the end of the section a distance greater by approximately one half of the space between the centers of spindle assemblies in the row than the spacing between the other end of the row from the other end of the section. This spacing can be conveniently utilized to support a receiver for temporarily storing spindle assembly heads when replacing yarn packages or when servicing the spindle assemblies. Preferably the width of each receiver is equivalent to approximately one half the spacing between the centers of spindle assemblies in the row and the receivers on opposite sides of the spindle frame are at opposite ends of the section. However, the receiver mounting feature can be utilized in an arrangement where the spindle assembly mounting means are not staggered and the spacings are at the same ends of both rows. In this regard the spacing feature is particularly applicable to the vertical spindle type machine.

This end spacing feature relates also to the aforementioned formation of the support plate from two flanged plate portions as the same plate portions can be formed for use in either position and only one type of plate portion need be produced. In this regard two identical support plate portions can be combined with the spacing at the same ends or one can be reversed so that the spacings are at opposite ends. This, therefore, further enhances the minimum parts and universal utilization of a minimum number of parts in making different types of machines.

So that a common spindle frame construction can be manufactured and inventoried for different types of machines, the support plate is made for mounting in a machine frame stand independent of the mounting on the machine frame of the means for driving the spindle assemblies. Preferably the means for driving the spindle assemblies is in the form of a belt drive assembly that includes a longitudinally extending beam secured at its ends to the vertical frame stands and disposed adjacent the side of the support plate from which the whorl portions project. The beam is aligned with the row of spindle assembly mounting means and is mounted to the machine frame independent of the mounting of the support plate. Drive belt guiding elements are supported on the beam adjacent the projecting whorl portions and a drive belt is guided and supported on the elements in driving engagement with the whorl portions, with means being provided for driving the belt. In the preferred embodiment there are two longitudinally extending rows of spindle assembly mounting means disposed on opposite sides of the longitudinal center line of the support plate, and the beam is disposed along the center line of the support plate with the beam and belt guiding elements disposed between the rows of spindle assembly mounting means. Thus, the spindle frame and the belt drive assembly are each independently constructed and are mounted independently on the machine frame, while having related components that result in a driving relationship when mounted in the frame. Also, with this arrangement different belt drive assemblies may be combined with the same type of spindle frame as long as there remains the operative relationship between the related components, particularly the relative disposition of the beam and belt guide elements of the belt drive assembly with respect to the whorl portions projecting from the spindle frame.

In the preferred embodiment a spindle assembly is provided for use in either a horizontal spindle or vertical spindle machine so that it is adaptable for either type of use and separate spindle assemblies for each type of machine are not required, thereby providing the same type of manufacturing and inventorying advantage as in the use of a single spindle frame for both types of machines as described above. This spindle assembly has a rotatable whorl portion and a yarn supporting portion, with the yarn supporting portion including means for alternative mounting thereon of magnet means for providing resistance to rotation of the yarn package when the spindle assembly is used in a machine having cooperative magnets on a stationary part, such as on a vertical spindle machine, or weight means offset from the spindle assembly axis to provide resistance to rotation when the spindle assembly is assembled in a machine with the axis of the spindle assembly extending horizontally. For this purpose, the yarn supporting portion includes a disc mounted concentrically on the assembly inwardly of a yarn package thereon, and the alternative mounting means comprises at least one segment formed in the disc adjacent the radial outward extent thereof and formed for receiving the magnet means and at least one other segment offset from the axis of the spring assembly formed for receiving the weight means. Preferably, the segment for receiving the magnet means is in the form of a recess.

DETAILED DESCRIPTION OF THE PREFERRED EMBODIMENTS OF THE PRESENT INVENTION

Figure 1:
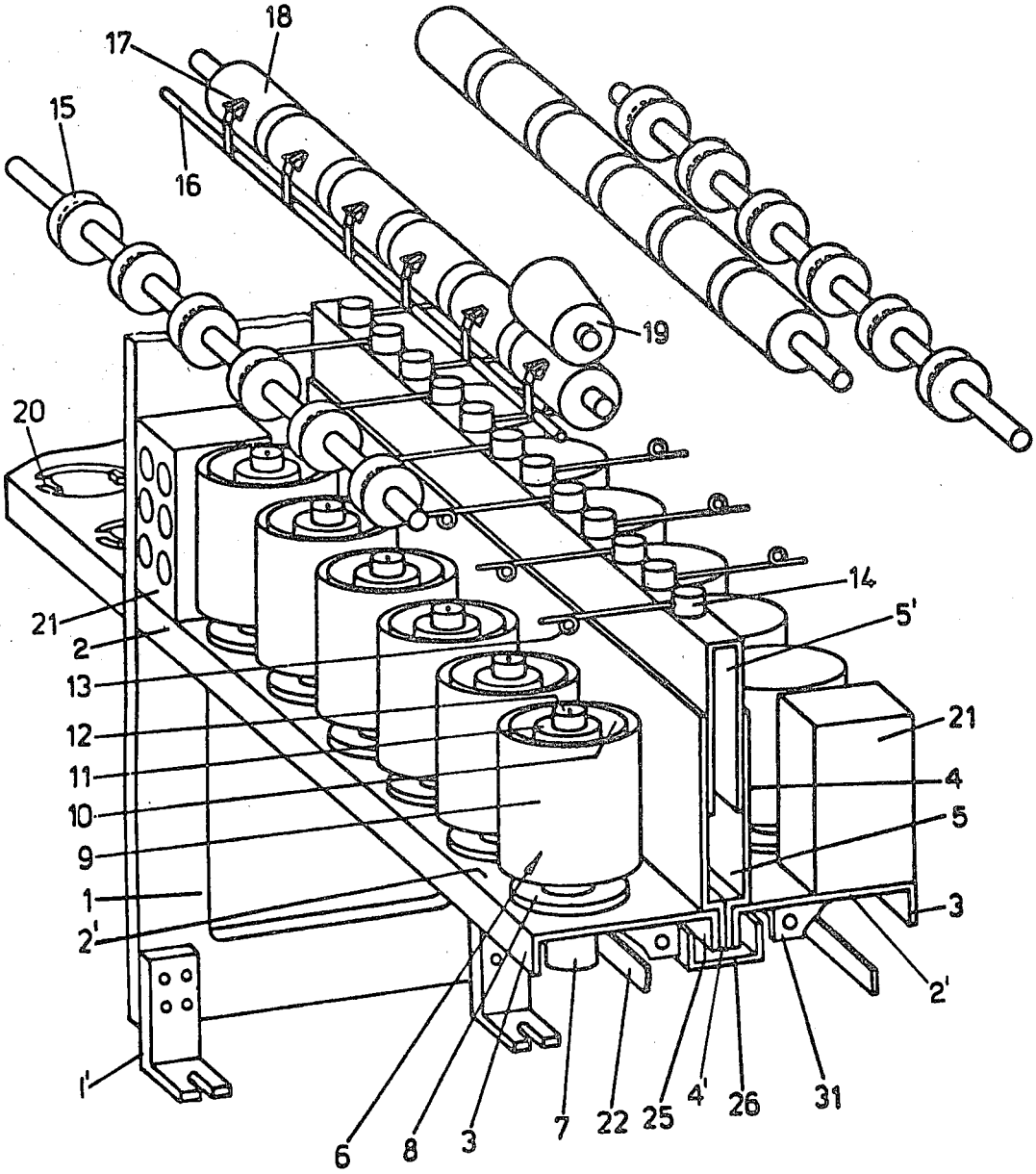
FIG. 1 is a partially broken-away perspective view of a multi-spindle double twist twisting machine of the type having vertically arranged spindle assemblies and in which the preferred embodiment of the present invention is incorporated.

Both vertical spindle and horizontal spindle type multi-spindle double twist twisting machines are illustrated and described herein, and insofar as the components are identical in the two types of machines, the same reference numerals are used herein for the components of both machines.

Figure 4:
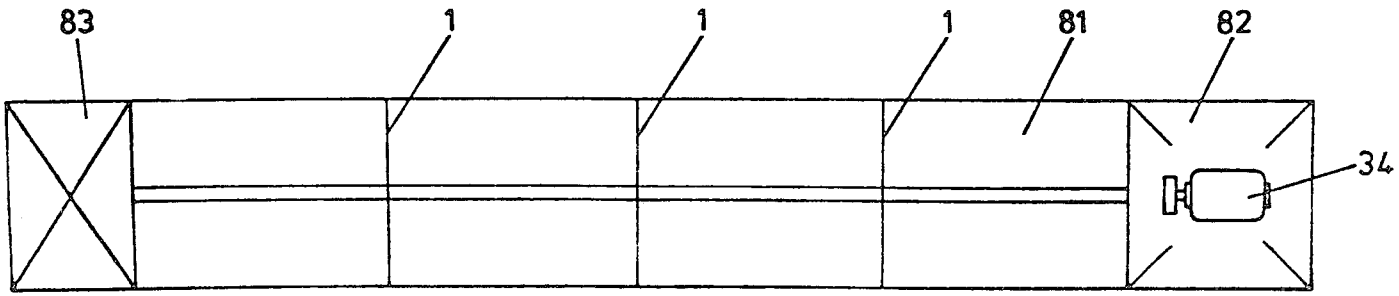
FIG. 4 is a schematic layout of the machine of FIG. 1 or the machine of FIG. 2.

Referring first to the vertical spindle machine of FIG. 1, it is seen that there is provided a vertical frame stand 1 that supports each end of each section of the machine and which is mounted to the floor by angle brackets 1'. As illustrated in FIG. 4, there are a plurality of machine sections 81, each being mounted between and on vertical frame stands 1. At one end of the machine is a drive housing 82 that contains the main drive components and at the other end of the machine is an end housing 83 containing other drive components of the machine.

In each machine section 81 a spindle frame 2 extends horizontally between the frame stands 1 and is secured thereto for support of spindle assemblies 6 in which delivery packages 11 are disposed for withdrawing of yarn by the machine in a double twist twisting operation. For this purpose the spindle assemblies 6 include a protection pot 10 in which the delivery package 11 is mounted and which pot is contained in a balloon limiter 9 of cylindrical construction for controlling the extent of ballooning of the yarn being discharged from the twisting operation in the spindle assembly as it passes upwardly through a ballooning yarn guide 13 around a take-off roll 15 through a traverse thread guide 17 that is carried by a traversing rod 16, and from which guide 13 the yarn passes onto a take-up package 19 that is driven by a take-up drive roll 18. There is such an arrangement of components for each spindle assembly 6 and the spindle assemblies are mounted in two parallel rows extending longitudinally of the machine with two rows of take-off rolls 15, and take-up drive rolls 18. In this vertical spindle machine the take-off rolls 15, traversing rods 16 and take-up drive rolls 18 may be driven by conventional drive mechanisms well known in the art and which do not require disclosure herein. Also, the specific details of the double twist twisting accomplished by the spindle assemblies is conventional and well-known such that a detailed disclosure is not necessary herein.

The spindle frame 2 is formed with two horizontal support plates 2' extending longitudinally between adjacent frame stands 1 and secured together in parallel relation. Each support plate is formed with longitudinal ends to which mounting brackets 31 are secured for mounting of the plate to the frame stands 1 at the ends of the machine section 81 without intermediate support, thereby serving as a self-supporting subframe that may be alternatively mountable in a horizontal spindle machine as well as in the presently described vertical spindle machine.

Each support plate 2' is formed for the mounting of a longitudinal row of spindle assemblies 6. For this purpose, each support plate 2' is formed with openings 20 arranged in a row for attaching therein of spindle assembly mounting means 8 in the form of bearing assemblies that attach in the openings in a bayonet-type lock. Such a spindle assembly mounting means 8 is disclosed in Rehn U.S. Pat. No. 3,716,980. The spindle assemblies 6 are mounted in the spindle assembly mounting means 8 with the whorl portion 7 of the spindle assembly 6 projecting in freestanding arrangement from one side of the support plate 2', downwardly in FIG. 1, and a yarn supporting portion of the spindle assembly projecting in freestanding arrangement from the other side of the plate 2', upwardly in FIG. 1.

Each support plate 2' is provided with side flanges 3 projecting from the longitudinal edges thereof in the direction of projection of the spindle assembly whorl portions 7 to provide sides to the spindle frame for rigidifying the frame and for attachment of enclosure plates as mentioned herein below. These side flanges 3 extend along not only the outer edges of the support plates 2' but also along the adjacent edges centrally of the spindle frame 2 for connection of the corresponding adjacent flanges for attachment of the support plates 2' to form an integral support plate. By having this support plate construction, a single form of support plate can be used on each side of the spindle frame so that only one type of support plate need be manufactured and inventoried.

Figure 3:
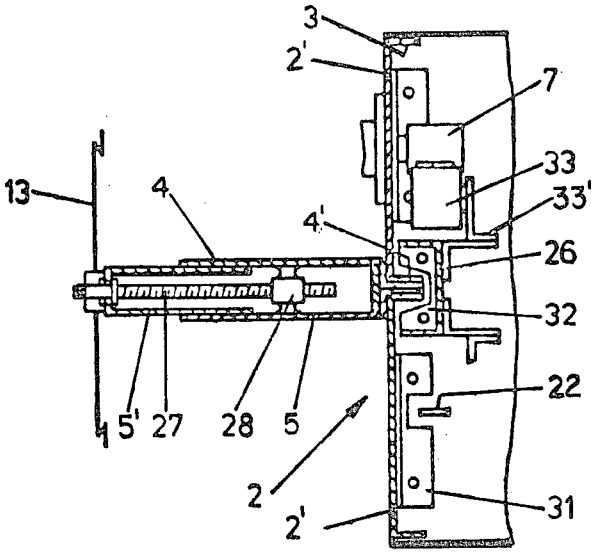
FIG. 3 is a vertical sectional view of a spindle frame included in both the machine of FIG. 1 and the machine of FIG. 2.

As seen in FIGS. 1 and 3, the support plate flanges 3 along the center of the spindle frame are secured together with a centrally located separator wall 4 projecting perpendicularly from the support plates 2' along the longitudinal center line of the spindle frame 2 on the side from which the spindle assembly yarn supporting portions project to provide separation of the spindle assemblies 6 in one row from those in the other and thereby prevent entanglement or other interference by a broken yarn from one spindle assembly with the yarn of a spindle assembly in the other row. The separator wall 4 is provided with a downwardly projecting flange 4' that extends longitudinally and centrally between the adjacent flanges 3 of the support plates 2' and through which the support plate flanges 3 are secured together by bolts, rivets, welding or other known connecting means. This integral incorporation of the separator wall in the support plate arrangement provides a spindle frame complete with separator wall that is capable of utilization in either a vertical or a horizontal spindle machine.

For versatility of the spindle frame 2, the separator wall 4 is made to be extendable perpendicularly of the support plates 2' to allow adjustment of the projecting extent of the separator wall and provide necessary separation with different size yarn packages and under different operating conditions while permitting adjustment to the least projecting extent necessary, thereby minimizing obstruction to access to the spindle frames and yarn packages. In the illustrated embodiment, the separator wall extension is provided by forming the separator wall 4 with an inner base portion 5 from which the flange 4 projects for attachment to the support plates 2' and formed in an upwardly opening U-shape for telescoping receipt of an outer adjustable portion 5' of inwardly opening U-shape construction. The outer portion 5' is adjustable within the inner portion 5 by means of stationary threaded sleeves 28 secured in the inner base portion 5 and threadably receiving a rotatable threaded rod 27 mounted in the outer portion 5' so that rotation of the rod 27 will advance or retract the rod in the sleeve 28 and thereby advance or retract the outer portion 5' within the inner portion 5. With this adjustable arrangement, the ballooning yarn guides 13, which are mounted on supports 14 on the outer ends of the outer portions 5' of the separator wall 4 are correspondingly adjustable for proper positioning of the yarn guides 13 with respect to the spindle assemblies 6 for optimum operating relation, and as all of the guides 13 for both spindle assembly rows are mounted on the common separator wall 4, single adjustment of the separator wall 4 will result in simultaneous and corresponding adjustment of all of the guides 13 in the machine section 81.

Figure 5:
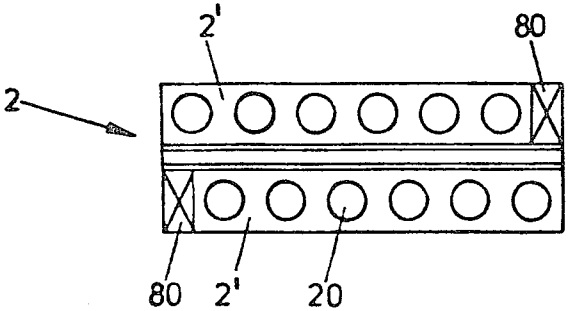
FIG. 5 is a diagrammatic illustration of an arrangement of support plates for a spindle frame of FIG. 3.
Figure 6:
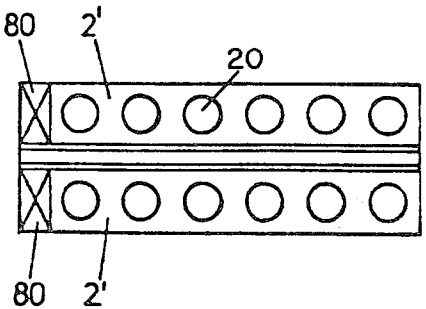
FIG. 6 is a view similar to FIG. 5 showing the support plates in an alternate arrangement.

The spindle assemblies 6 in one row are arranged as illustrated in FIG. 1 in staggered relation with respect to the spindle assemblies 6 in the adjacent row, which facilitates the arrangement of the mounting of the ballooning yarn guides 13 for both rows in longitudinal alternate alignment on the common separator wall 4. The staggered relation is accomplished by having the spindle assembly mounting means 8 in both rows equally spaced and with the spindle assembly mounting means in one row staggered with respect to the spindle assembly mounting means in the other row at a spacing of approximately one-half the spacing between the centers of spindle assemblies. This will provide a spacing between one end of each row and the end of the machine section 81 a distance greater by approximately one-half of the space between the centers of spindle assemblies in the row than the spacing between the other end of the row from the other end of the section. This is illustrated in FIG. 5. This results in a free space 80 at one end of the machine, which space can be conveniently utilized to support a receiver 21 for temporarily storing spindle assembly heads 12 when replacing yarn packages or when servicing the spindle assemblies. Preferably, the width of each receiver is equivalent to approximately one-half the spacing between the centers of spindle assemblies 8 in the row and the receivers on opposite sides of the spindle frame are at the opposite ends of the section. As the support plates 2' are identical, they can be connected together in the aforementioned staggered relation or one of the support plates 2' can be reversed so that the spindle assemblies 6 are aligned, which would result in the receivers 21 being at the same end of the machine section 81. This is illustrated in FIG. 6.

The above-described spindle frame 2 and its advantageous sub-frame construction as well as its use of identical support plates 2' is uniquely applicable to a horizontal spindle machine as to the described vertical spindle machine, which enhances the versatility of the spindle frame 2 and increases its commercial utilization. This is particularly so for a manufacturer of both horizontal spindle and vertical spindle machines as production and inventorying of only one type of spindle frame 2 is necessary to satisfy the needs for both types of machines. Further, this spindle frame 2 is designed for mounting in a machine independent of the spindle drive system so that variations in drive systems will not reduce the versatile utilization of this spindle frame.

Figure 2:
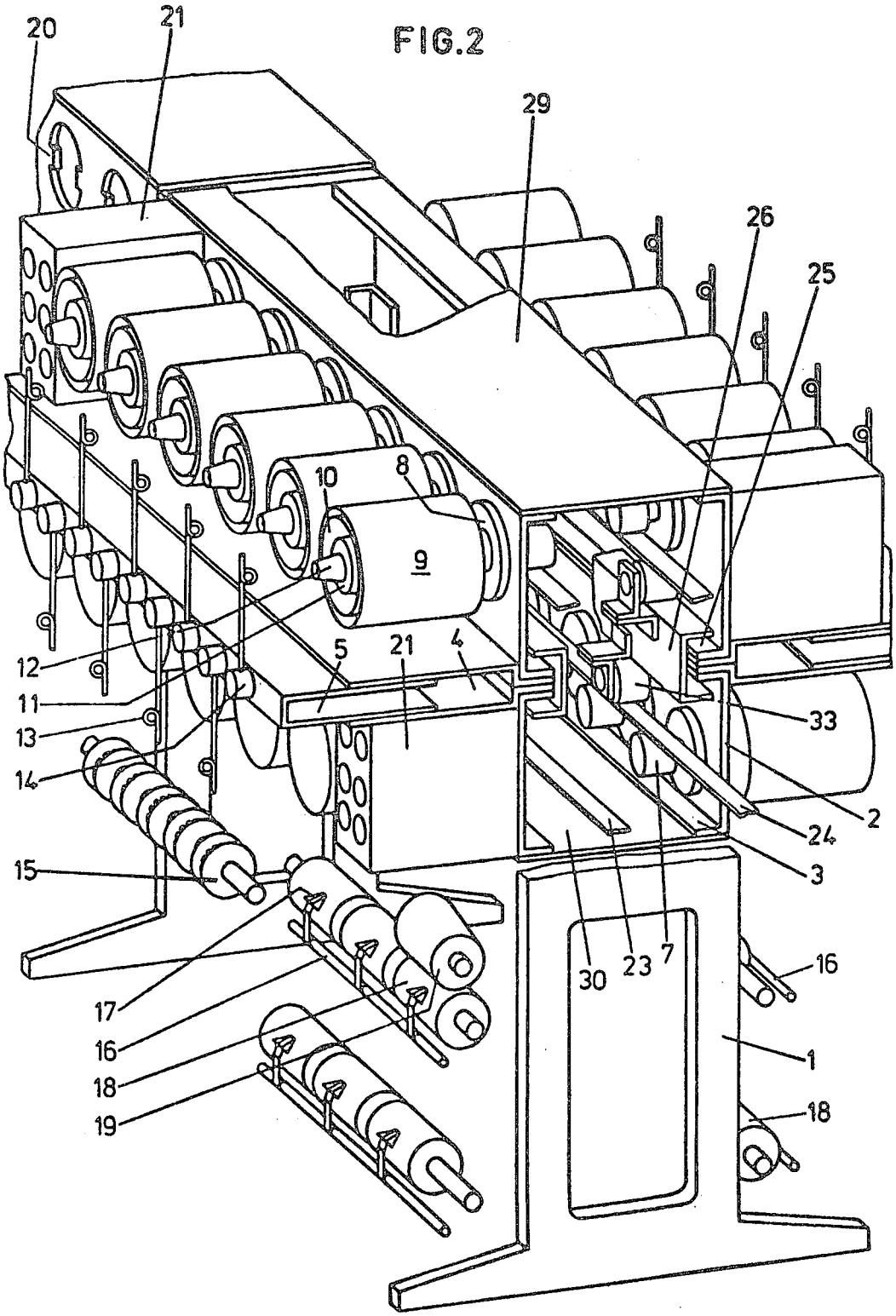
FIG. 2 is a partially broken-away perspective view of a multi-spindle double twist twisting machine of the type having horizontally arranged spindle assemblies and in which the preferred embodiment of the present invention is incorporated.

The application of this spindle frame 2 to a horizontal spindle machine is illustrated in FIG. 2 in which two spindle frames 2 identical to the spindle frame of FIG. 1 are arranged with the spindle assemblies 6 projecting horizontally and with one spindle frame 2 on each side of the machine spaced apart to provide a space for accommodating the spindle drive mechanism. In this horizontal spindle machine the staggered relation of the spindle assemblies 6 is of particular significance as the take-off rolls 15 and take-up drive rolls 18 for both rows of spindle assemblies 6 are below the spindle frame 2, requiring the yarn from the upper row of spindle assemblies 6 to pass across the lower row of spindle assemblies 6. With this staggered relation, the take-off from the spindle assemblies in the upper row will pass between the spindle assemblies in the lower row without interference and will also avoid interference with the take-off rolls 15 and take-up drive rolls 18 for the other spindle assembly row.

The aforementioned support plate flanges 3 serve a further function in the horizontal spindle machine as they provide supports for attachment of enclosure plates 29 and 30 that extend across the machine section 81 between adjacent spindle frames 2 at the top and bottom thereof, thereby forming with the spindle frames 2 an enclosure to reduce noise transmission created by the spindle drive mechanism contained within the enclosure, which noise dampening is further enhanced by applying a liner of any conventional noise dampening material on the interior of the enclosure. The enclosure also conveniently can serve as a conduit for air circulation and for control lines.

As will be described hereinafter, the spindle drive mechanisms for the horizontal spindle machine is different than the spindle drive mechanism for the vertical spindle machine, but the present spindle frame construction is importantly independent of the spindle drive mechanism such that the same spindle frames 2 can be used in either type of machine without limitation to the drive mechanism. Also, it should be noted that in the horizontal spindle machine the take-off rolls 15, the traversing rods 16 and the take-up drive rolls 18 may be conventionally driven as in the case of the vertical spindle machine described above, but preferably the traversing rods 16 are reciprocated by the particular mechanism described hereinbelow.

The spindle frame 2 of the present invention has further versatility in that a single support plate 2' could be used without change in a machine in which only one row of spindle assemblies is to be arranged, and support plates 2' can be combined without change without a separator wall. Also, the separator wall 4 can be modified where balloon limiters 9 are used as in such case it is not necessary that the separator wall be solid in the location of the balloon limiter and the inner base portion 5 of the separator wall 4 could be eliminated and mountings provided for the stationary threaded sleeves 28, thereby providing for adjustability of the adjustable portion 5' beyond the extent of the balloon limiter 9.

The means for driving the spindle assemblies is the same for the vertical spindle machine and the horizontal spindle machine in terms of the components directly associated with each spindle frame 2, but differ in the arrangements beyond the machine sections 81 for driving the belts of the drive means. In the vertical spindle machine in which only one spindle frame 2 is utilized in each machine section 81, a single drive belt 22 runs the length of the machine with a reach of the belt driving the whorl portions 7 of one row of spindle assemblies 6 and the other reach of the belt 22 driving the whorl portions 7 of the spindle assemblies 6 of the other row. In the horizontal spindle machine there is a similar drive belt 23 similarly associated with one spindle frame 2 and another drive belt 24 similarly associated with the other spindle frame. These drive belts 22, 23 and 24 extend longitudinally in tangential contact with the whorl portions 7 of the spindle assemblies 6 and are maintained in driving engagement therewith by belt supporting and guiding elements or rolls 33 located on the opposite side of the belt from the whorl portions 7 and intermediate each pair of whorl portions 7. These guiding rolls 33 are mounted on brackets 33' that project from a beam 26 that extends longitudinally through the machine section 81 adjacent the whorl portions 7 along the longitudinal center line of the spindle frame 2 between the rows of spindle assemblies 6. These beams are U-shaped and overlap the center flanges 3 of the support plates 2', but importantly are not in contact with or connected to the spindle frame 2. Rather, the beams 26 are mounted by mounting plates 32 to the frame stands 1 at the longitudinal ends of the beams 26. This independent mounting of the beams 26 permits use of a spindle frame construction that is not dependent on the belt drive means and similarly allows the use of a drive belt means that is not dependent on the spindle frame. It also allows inventorying of sub-assemblies of spindle frames and separates noise generation by the belt drive means from the spindle frame and isolates noise within the aforementioned enclosure.

Figure 7:
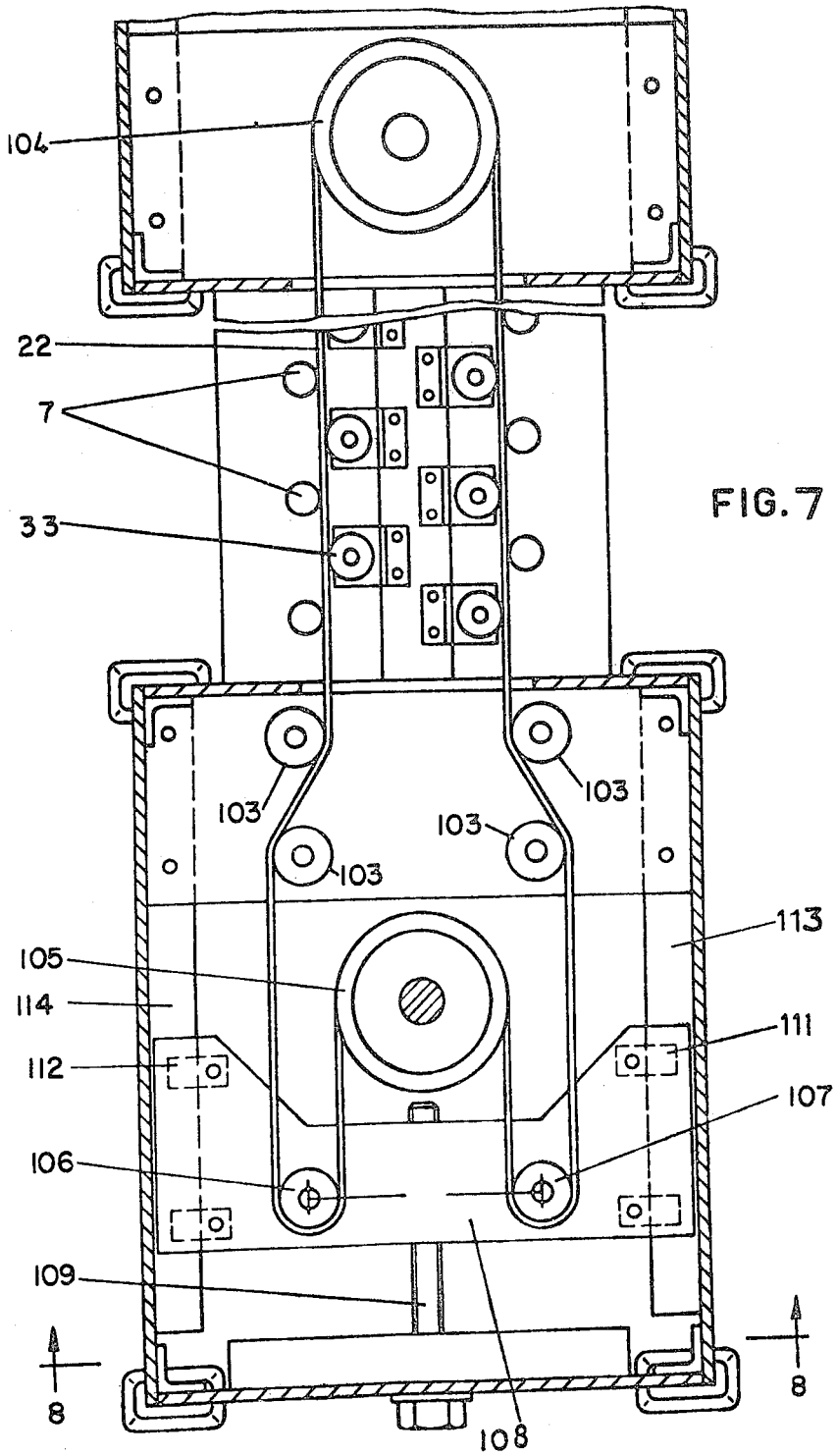
FIG. 7 is a horizontal sectional view illustrating the belt drive assembly of the vertical spindle machine of FIG. 1.
Figure 8:
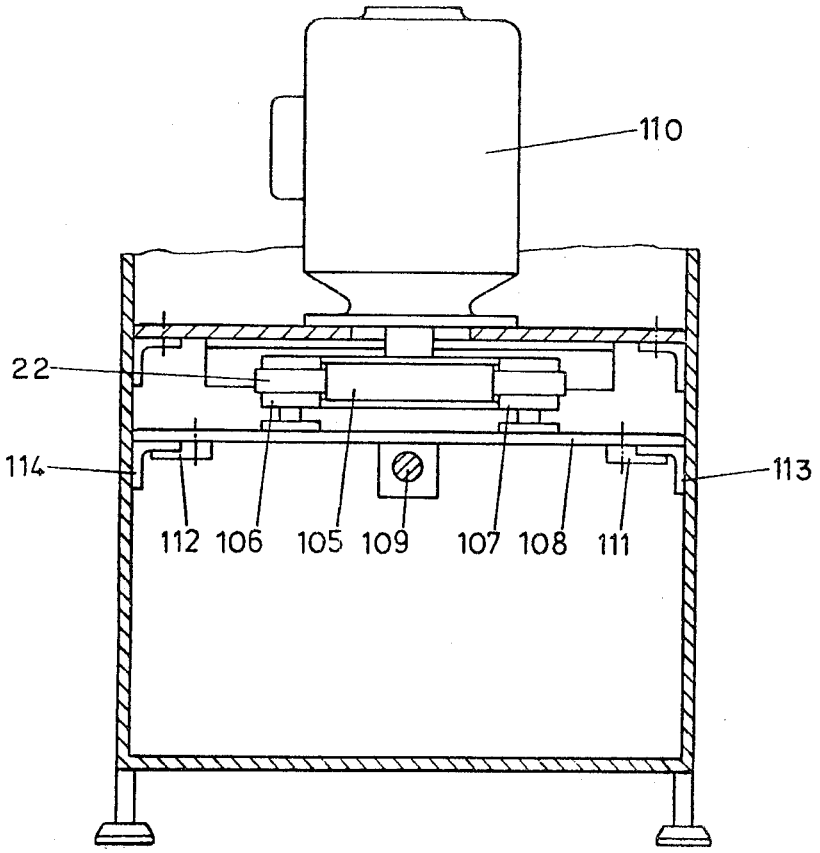
FIG. 8 is a vertical sectional view taken along line 8—8 of FIG. 7.

The aforementioned belt drive assembly when utilized in the vertical spindle machine is driven by the mechanism illustrated in FIGS. 7 and 8. As the belt 22 contacts the whorl portions 7 of the spindle assemblies 6 tangentially, it must be maintained taut to impart positive frictional drive without slipping. Due to the natural elasticity of belt material and the long length of the reach of the belt throughout the entire machine, means must be included to adjustably tension the belt during operation. As seen in FIG. 7, the belt travels along one reach past the whorl portions 7 of the spindle assemblies 6 in one row and around an idler roll 104 in the aforementioned end housing 83 at one end of the machine. The belt 22 then passes through its other reach in driving contact with the whorl portions 7 of the spindle assemblies 6 in the other row to the drive housing 82 at the other end of the machine. In the drive housing 82 the belt passes around guide rolls 103 that deflect the reach of the belt laterally outward and from which the belt passes around a movable roll 106 back to a stationary drive roll 105 and then around another movable roll 107. The movable rolls 106 and 107 are located longitudinally beyond the stationary drive roll 105 to impose belt contact on the drive roll over substantially half the surface thereof and thereby obtaining positive driving of the belt by the drive roll 105 which is driven by a conventional drive motor 110 (FIG. 8) in the drive housing 82. To tension the belt 22 and maintain tautness sufficient for positive driving of the whorl portions 7, the movable rolls 106 and 107 are mounted on a horizontally disposed slide 108 mounted for longitudinal sliding on horizontal guide rails 113 and 114 in the drive housing 82, with the slide 108 being maintained on the guide rails 113 and 114 by angle brackets 111 and 112, respectively. The slide 108 is adjustable to take up slack in the belt 22 by a threaded rod 109 extending through the end of the drive housing 82 into threadable engagement with the slide 108, whereby rotation of the threaded rod 109 will cause the slide 108 to advance to the end of the drive housing 82 to increase tension on the belt 22 or to advance away from the housing end to relieve tension on the belt.

Figure 9:
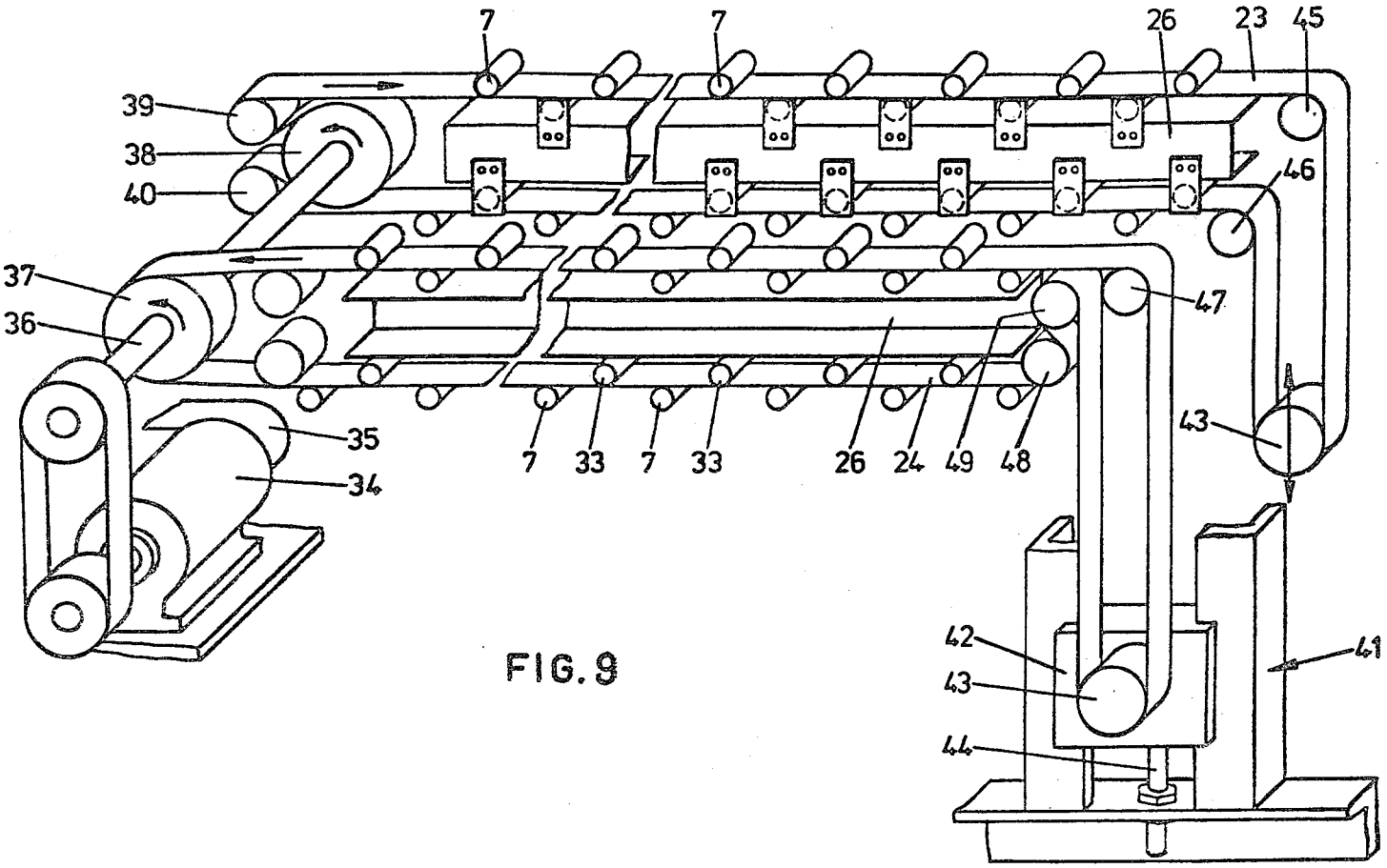
FIG. 9 is a perspective view, partially broken away, illustrating the belt drive assembly of the horizontal spindle machine of FIG. 2.

In the horizontal spindle machine separate drive means may be provided for each belt 23, 24, but preferably for cost and space economies, a single drive motor 34 is utilized to drive both of the belts as well as the traversing rods 16. The preferred belt drive assembly for the horizontal spindle machine is illustrated in FIG. 9, which shows the previously described support and guidance of the drive belts in tangential driving contact with the whorl portions 7 of two rows of spindle assemblies 6 on each side of the machine. The drive belts are supported and guided in tangential driving contact with the whorl portions 7 and the drive means drives the belts in opposite directions so that the winding operation will be in the same rotational direction when facing either side of the machine. To accomplish this operation, the drive motor 34 drives the traversing rod drive belt 35 for purposes explained herein below and also rotates a drive shaft 36 on which a pair of belt drive rolls 37 and 38 are mounted in alignment with the belts 23 and 24 for training of the belts therearound. As illustrated in FIG. 9, the belt 24 in front in this figure passes directly around the drive roll 37 in a counterclockwise direction for movement of the upper reach of the belt to the left and the lower reach of the belt to the right, thereby imparting a clockwise rotation to the whorl portions 7 of the spindle assemblies. So that the whorl portions 7 of the spindle assemblies 6 on the back side of the machine in FIG. 9 will also rotate in a clockwise direction when facing the back side of the machine, the upper reach of the back belt 23 is caused to move to the right and the lower reach to the left, which is the opposite of the direction of movement of the front belt 24. To accomplish this with counterclockwise rotation of the drive roll 38, a pair of reversing rolls 39, 40 are disposed beyond the back drive roll 38 with one of the reversing rolls 39 extending above the level of the drive roll 38 and the other reversing roll 40 extending below the level of the drive roll 38. In this manner the back belt 23 is trained around the lower reversing roll 40 back around the drive roll 38 and then around the upper reversing roll 39, resulting in a direction of travel opposite to that of the front belt 24 that is trained directly around its drive roll 37. However, this results in a longer belt path for the back belt 23 than for the front belt 24. To compensate for this so that a single length belt can be stocked for use as either drive belt, a compensating roll 49 is mounted at the opposite end of the machine at an upward offset from the lower reach of the front belt 24 for training of the belt at the end of the lower reach around a deflection roll 48 to the compensating roll 49 and then down to a tensioning device, with the amount of offset of the compensating roll 49 being equivalent to the cumulative offset resulting from the use of the reversing roll 39, 40 for the rear belt 23, thereby increasing the travel length substantially equivalent to the increase in the travel length resulting from the reversing rolls.

To maintain proper tension of the belts 23 and 24 for tangential driving contact of the whorl portions 7, belt tensioning means are disposed beyond and offset from the end of the reaches of the belts opposite the drive rolls 37 and 38 for tensioning and deflecting the belts at an inclination from the horizontal extent of the belt reaches. There is such a belt tensioning means associated with each of the belts, but for simplicity of illustration only the belt tensioning means associated with the front belt 24 is illustrated in FIG. 9. This belt tensioning means includes a slide member 42 movable at the inclination of deflection, which is vertical in FIG. 9, and which slide member 42 has mounted thereon a tensioning roll 43 for movement therewith and around which the drive belt 24 is trained at its outer extent. The slide member 42 slides in a slideway 41 and a threaded rod 44 connects the slide member 42 and slideway 41 for adjusting the position of the slide member 42 with respect to the slideway 41 by threaded adjustment of the threaded rod 44 in the slideway 41. Guide rolls 45 and 46 are provided for training the rear belt 23 from its horizontal reaches to the tensioning roll 43, and a guide roll 47 is provided for training the front belt 24 from its upper reach down to the tension roll 43 while the compensating roll 49 serves the same purpose, in addition to increasing the belt length, for the front belt at the end of its lower reach.

Figure 10:
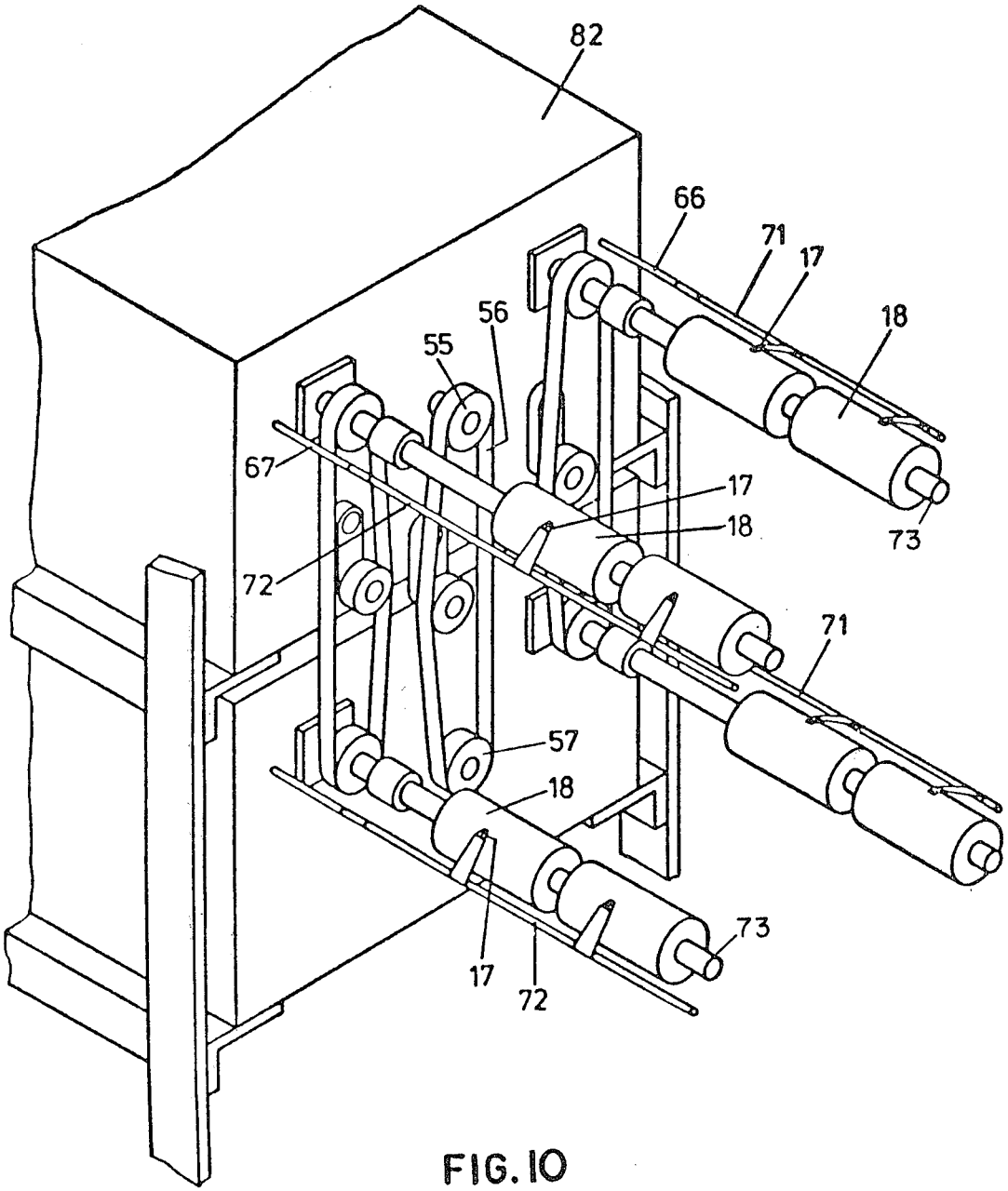
FIG. 10 is a partially broken-away perspective view of the drive housing and traversing rod driving means of the horizontal spindle machine of FIG. 2.
Figure 11:
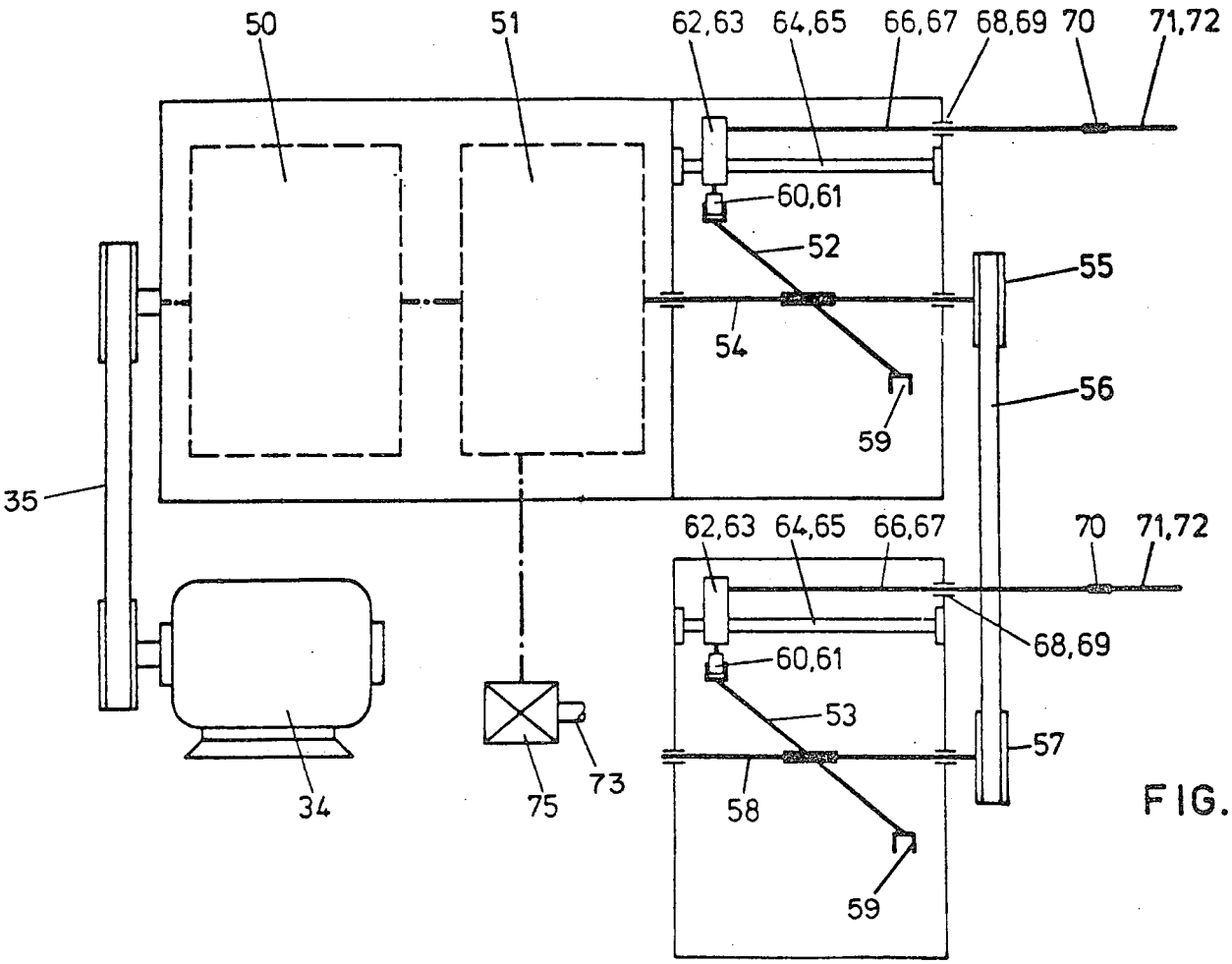
FIG. 11 is a diagrammatic illustration of the means for reciprocating the traversing rods of the horizontal spindle machine of FIG. 2.
Figure 12:
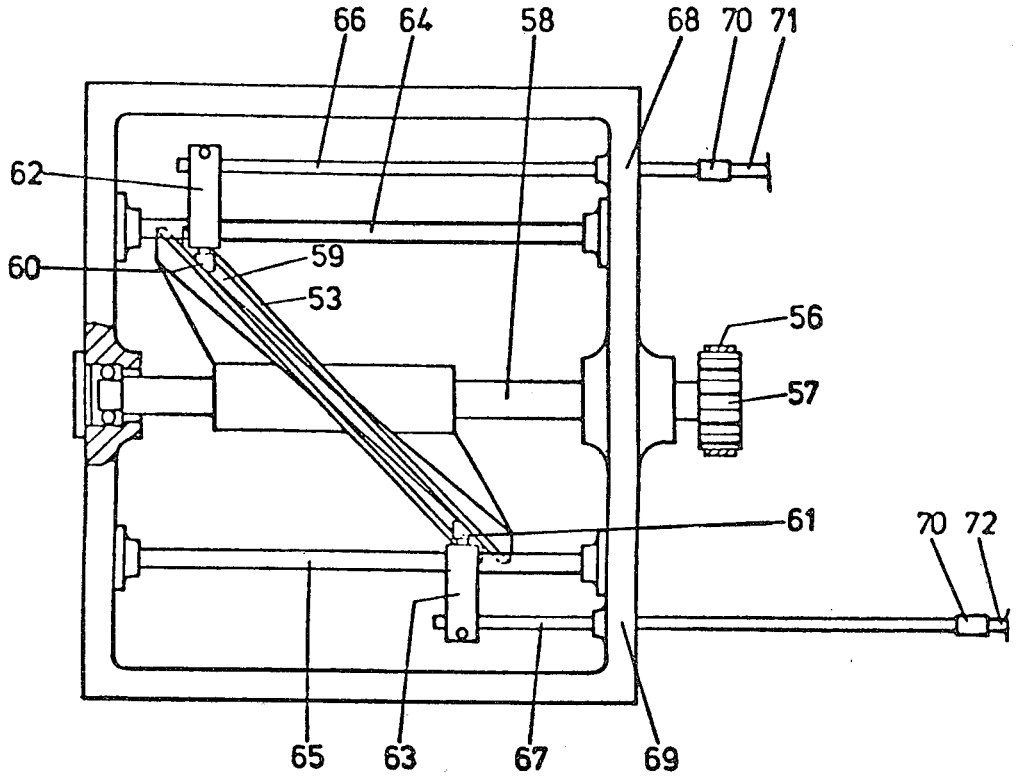
FIG. 12 is a plan view of the cam drive mechanism of the means for reciprocating the traversing rods illustrated in FIGS. 10 and 11.

The aforementioned traversing rods 16 are driven by the same drive motor 34 as the belt drive assembly through means for reciprocating the traversing rods that includes conventional means for reciprocating the two upper rods while incorporating a unique connection for operating the two lower traversing rods rather than utilizing a separate drive means. This means for reciprocating the traversing rods is illustrated in FIGS. 10, 11 and 12, which shows the aforementioned drive motor 34 driving the traversing rod drive belt 35, which in turn drives a conventional replaceable gear assembly that produces a desirable output in relation to the input from the drive motor 34 and can be replaced by gear assemblies of different ratios for producing different operating speeds. The replaceable gear assembly 50 in turn drives a traverse modulating gear assembly 51 of conventional design that imposes a modulated traversing pattern to the take-up winding of the yarn through a drive connection 75 for driving the shafts 73 on which the take-up drive rolls 18 are mounted. The output of the traverse modulating gear assembly 51 is also imposed on a cam drive shaft 54 on which a cam disc 52 is mounted for rotation. The cam disc 52 is formed with a peripheral groove 59 in which spaced cam followers 60 and 61 are disposed for movement thereby to cause reciprocation of connected slide members 62 and 63 on horizontal guide bars 64 and 65. The slide members 62 and 63 are connected to coupling rods 66 and 67 for reciprocation thereof through bearings 68 and 69 in the drive housing 82. The coupling rods 66 and 67 are aligned with the upper traversing rods 71 and 72 for reciprocal driving connection thereto through couplings 70. As described to this point, the means for reciprocating the traversing rods is of conventional construction.

However, rather than using another conventional driving mechanism to reciprocate the lower traversing rods, drive is taken directly and synchronously from the cam shaft 54 on which a pulley 55 is mounted for driving a belt 56 that rotates a pulley 57 mounted on the end of another cam drive shaft 58 on which a second cam disc 53 is mounted. This second cam disc 53 is identical to the first cam disc 52 and through similar operating connections drives the lower traversing rods 71 and 72 (which are designated 16 in FIGS. 1 and 2). Thus, a drive take-off means is provided for driving the second cam and cam follower from the first cam without an additional drive motor or gear assemblies. FIG. 11 is a schematic illustration of the described construction and FIG. 12 is a view of the second cam disc 53 and connecting components, which are identical to the first cam disc 52 and connecting components. It should be noted that FIG. 12 is a horizontal view of the cam disc arrangement showing the cam followers at a horizontal spacing, whereas FIG. 11 is simply a schematic illustration in which the spacings of the cam followers is not apparent.

This means for reciprocating the traversing rods can also be used in a vertical spindle machine of the type having two levels of spindle assembly rows wherein there are two vertically spaced spindle frames.

Figure 13:
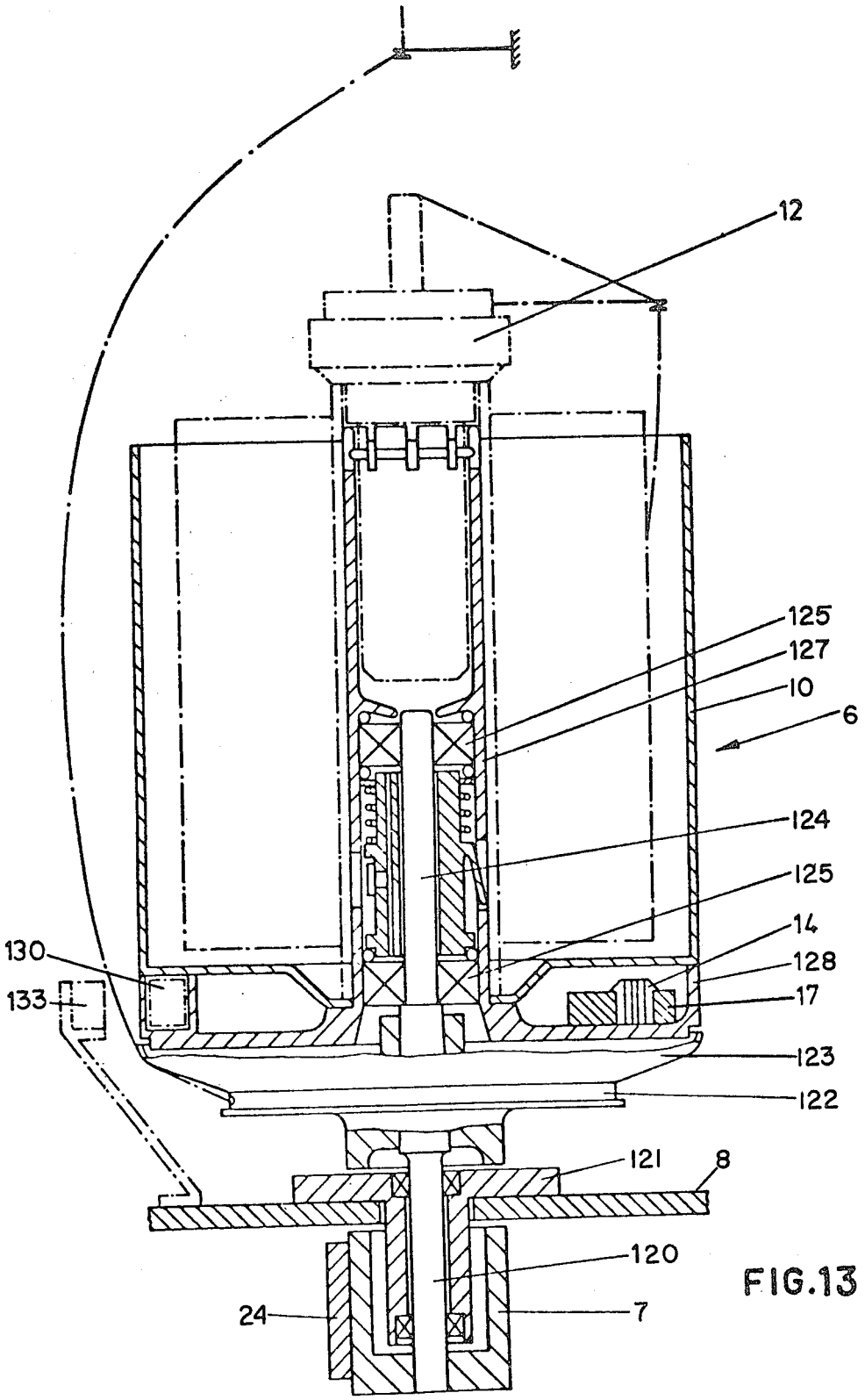
FIG. 13 is a vertical sectional view of the preferred embodiment of the spindle assembly used in the machines of FIGS. 1 and 2.
Figure 14:
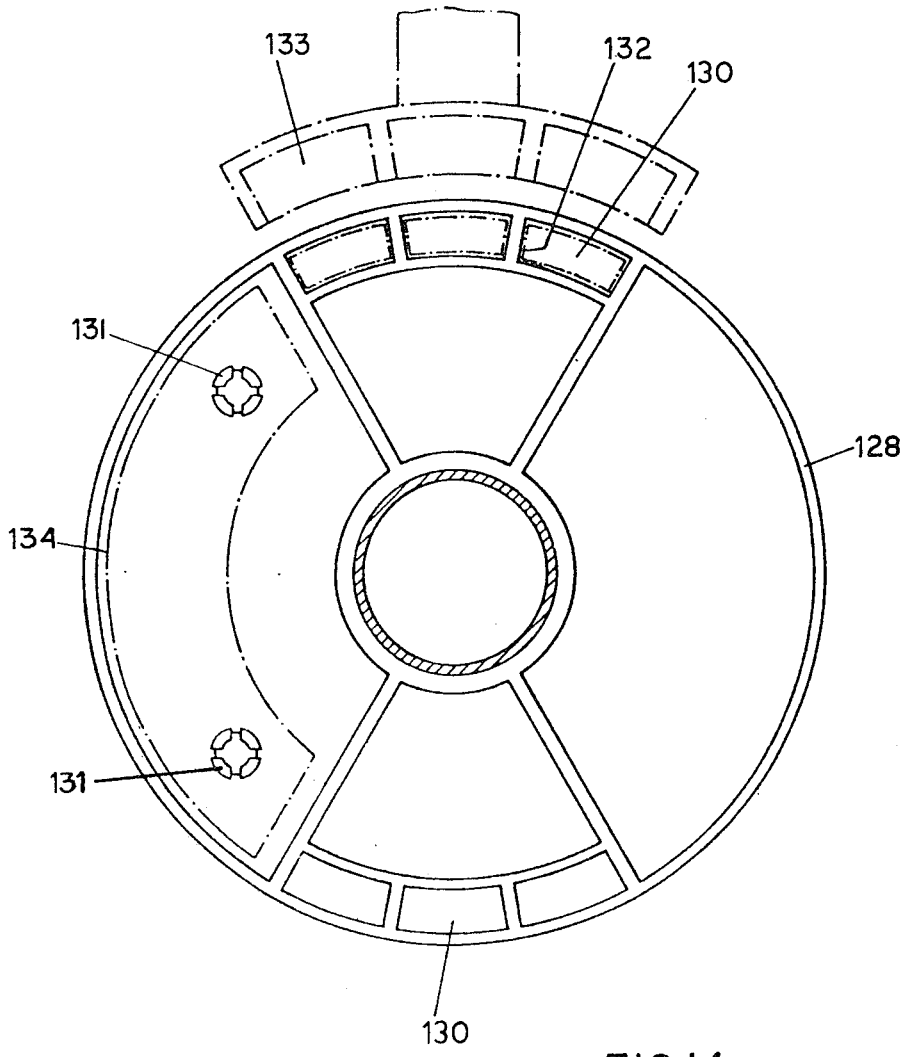
FIG. 14 is a plan view of the package carrier plate of the spindle assembly of FIG. 13.

Further versatility of the double twist twisting machines disclosed herein is provided in the construction of the spindle assemblies 6 so that one spindle assembly construction can be utilized in either a horizontal spindle machine or a vertical spindle machine, thereby requiring the stocking of only one type of spindle assembly. In this regard, the spindle assembly, as illustrated in FIGS. 13 and 14, is generally of a known type having a rotor 120 mounted for rotation in a bearing 121 that is secured in the spindle assembly mounting means 8. The rotor 120 has at its outer end a whorl portion 7 fixed thereto for driving by a drive belt 24. The whorl portion 7 projects from one side of the mounting means 8 and the rotor 120 projects also on the other side of the mounting means 8 for connection with a spindle 124 that is drivingly connected to a yarn guide plate 123 that includes a yarn storage disc 122 of known construction. Mounted through ball bearings 125 and 126 on the spindle 124 is a yarn package supporting tube 127, the lower portion of which is formed as a circular package carrier plate 128. At the top of the tube 127 there is mounted the removable yarn brake head assembly 12 and mounted on the package carrier plate 128 is the protection pot 10.

The present invention adds to this spindle assembly construction the capability of using a conventional magnet system for retaining the package carrier plate 128 against rotation during operation in a vertical spindle machine and a weight system for offset weighting of the package carrier plate to resist rotation during operation of the spindle assembly in a horizontal spindle machine. For this purpose, the package carrier plate 128 is formed with recessed segments or pockets 130 on its outwardly facing surface and adjacent the circumferential periphery thereof for receipt of magnets 132. These magents 132 will cooperate with conventional stationary magnets 133 mounted on the spindle assembly mounting means 8 exteriorly of the spindle assembly 6 for resisting rotation of the plate 128 by magnetic attraction when the spindle assembly is used in a vertical spindle machine. The package carrier plate 128 is also formed at another circumferential location with a pair of projecting mounting posts 131 on which an arcuate weight 134 may be mounted. The posts 131 are resiliently formed for a snap fit of the weight 134 thereon to permit dislodgement of the weight when the spindle assembly 6 is used in a horizontal spindle machine, in which case the gravitational pull of the weight, being offset from the spindle 124, will tend to retain the package carrier plate 128 against rotation.

It should be noted that the belt drive assembly, enclosure and traversing rod features described herein are included for completeness of description and that these features do not form part of the present invention. Rather, these features are disclosed and claimed in a concurrently filed application owned by the common assignee, the inventors of which are identified as Shippers, Hartig, Weber, Blumberg, and Wessolowski.

Further it should be understood that the detailed illustration and description contained herein is provided for purposes of disclosure only and that the scope of the present invention is not intended to be limited solely thereto as the scope of the invention is intended to be defined by the appended claims and equivalents and variations thereof.

We claim:

1. A spindle frame for supporting a plurality of spindle assemblies in multi-spindle double twist twisting machines of the type having vertical frame stands at the ends of sections of the machine, said spindle frame comprising a support plate formed for mounting spindle assemblies thereon, a plurality of spindle assembly mounting means on said plate for mounting spindle assemblies thereon with whorl portions of said spindle assemblies projecting in freestanding arrangement from one side of said plate and yarn supporting portions of said spindle assemblies projecting in freestanding arrangement from the other side of said plate, said support plate having longitudinal ends for mounting of said plate in the vertical frame stands at the ends of a machine section without intermediate support as a self-supporting subframe mountable alternatively in either a machine of the type in which the spindle assemblies are disposed with the axes vertical or a machine of the type in which the spindle assemblies are disposed with their axes horizontal.

2. A spindle frame according to claim 1 and characterized further in that said spindle frame includes two longitudinal rows of said spindle assembly mounting means on said plate, said rows being disposed on opposite sides of the longitudinal center line of said support plate.

3. A spindle frame according to claim 2 and characterized further in that said spindle assembly mounting means in one of said rows are staggered longitudinally with respect to the spindle assembly mounting means in the other row.

4. A spindle frame according to either claim 1 or claim 2 characterized further in that said support plate has side flanges projecting from the longitudinal edges thereof in the direction of projection of said whorl portions to provide sides to said spindle frame for rigidifying the frame and for attachemnt of enclosure plates thereto.

5. A spindle frame according to claim 2 and characterized further in that said support plate is formed of two longitudinally extending plate portions, each portion having one row of said spindle assembly mounting means thereof, and said plate portions being attached to each other along adjacent longitudinal edges thereof to form an integral support plate.

6. A spindle frame according to claim 5 and characterized further by a separator wall mounted on said support plate along the longitudinal center line thereof and projecting perpendicularly therefrom on the side from which said yarn supporting portions project, and said separator wall being secured to said adjacent support plate portion.

7. A spindle frame according to claim 5 and characterized further in that each said plate portion has a perpendicularly projecting flange along the longitudinal edge thereof adjacent the other plate portion and connected to the corresponding flange of the other plate portion for attachment of said plate portions.

8. A spindle frame according to claim 7 and characterized further by a separator wall mounted on said support plate along the longitudinal center line thereof and projecting perpendicularly therefrom on the side from which said yarn supporting portions project, said separator wall having an attaching flange extending longitudinally therealong and projecting therefrom between said adjacent support plate portion flanges, and said separator wall flange being secured to and between said adjacent support plate portion flanges.

9. A spindle frame according to claim 5 and characterized further in that said plate portions are identical and said spindle assembly mounting means are offset toward one end of each plate portion for alternative attachment of said plate portions with said spindle assembly mounting means of both plate portions offset toward the same end to provide alignment of spindle assemblies in the row on one plate portion with the spindle assemblies in the row on the other plate portion or attachment of said plate portions with said spindle assembly mounting means of respective plate portions offset toward opposite ends to provide a staggered arrangement of spindle assemblies in the row on one plate portion with respect to the spindle assemblies in the row on the other plate portion.

10. A spindle frame according to claim 7 and characterized further in that said plate portions are identical and said spindle assembly mounting means are offset toward one end of each plate portion for alternative attachment of said plate portions with said spindle assembly mounting means of both plate portions offset toward the same end to provide alignment of spindle assemblies in the row on one plate portion with the spindle assemblies in the row on the other plate portion or attachment of said plate portions with said spindle assembly mounting means of respective plate portions offset toward opposite ends to provide a staggered arrangement of spindle assemblies in the row on one plate portion with respect to the spindle assemblies in the row on the other plate portion.

11. A spindle frame according to claim 2 and characterized further by a separator wall mounted on said support plate along the longitudinal center line thereof and projecting perpendicularly therefrom on the side from which said yarn supporting portions project.

12. A spindle frame according to claim 11 and characterized further in that said separator wall is extendable perpendicularly of said support plate.

13. A spindle frame according to either claim 11 or claim 8 and characterized further by ballooning yarn guides mounted on said separator wall and projecting therefrom beyond said spindle assemblies for guiding therethrough yarn ballooning from said spindle assemblies.

14. A spindle frame according to claim 12 and characterized further in that said separator wall comprises an inner base portion secured to said support plate and an outer adjustable portion mounted on said inner base portion for adjustable positioning with respect thereto for adjustment of the extent of said separator wall perpendicular to said support plate.

15. A spindle frame according to claim 14 and characterized further in that said inner and outer portions of said separator wall are disposed in telescoping relation for extension of said separator wall.

16. A spindle frame according to claim 14 and characterized further by ballooning yarn guides mounted on said adjustable outer portion of said separator wall for extendable adjustment therewith and projecting therefrom beyond said spindle assemblies for guiding therethrough of yarn ballooning from said spindle assemblies.

17. A spindle frame according to claim 1 and characterized further in that said spindle assembly mounting means are disposed on said plate for mounting of spindle assemblies with the spindle assembly adjacent one end of said plate spaced from said one end a distance from its center greater by approximately one half the distance between centers of spindle assemblies than the distance the spindle assembly adjacent the other end of said support plate is spaced therefrom.

18. A spindle frame according to claim 17 and characterized further in that there are two longitudinal rows of said spindle assembly mounting means on said support plate for mounting of spindle assemblies with the spindle assembly adjacent one end of said plate in each row being spaced from said one end a distance from its center greater by approximately one half the distance between centers of spindle assemblies than the distance the spindle assembly adjacent the other end of said support plate in each row is spaced from said other end.

19. A spindle frame according to claim 17 and characterized further in that there are two longitudinal rows of said spindle assembly mounting means on said support plate for mounting of spindle assemblies with the spindle assembly adjacent one end of said plate in one row being spaced from said one end a distance from its center greater by approximately one half the distance between centers of spindle assemblies than the distance the spindle assembly adjacent the other end of said support plate in said one row is spaced from said other end, and the spindle assembly adjacent said other end of said support plate in the other row being spaced from said other end a distance from its center greater by approximately one half the distance between centers of spindle assemblies than the distance the spindle assembly adjacent said one end of said support plate in said other row is spaced from said one end.

20. A spindle frame according to claim 1 and characterized further by a row of spindle assemblies mounted in said mounting means on said support plate and each having a yarn package supporting portion including means for alternative mounting thereof of a magnet means for providing resistance to rotation when in a machine having cooperative magnets on a stationary part or weight means offset from the spindle assembly axis to provide resistance to rotation when said spindle frame is assembled in a machine with the axes of the spindle assemblies extending horizontally.

21. A spindle frame according to claim 20 and characterized further in that said spindle assemblies include yarn package supporting discs formed with a plurality of segments, at least one of said segments being formed for receiving said magnet means and at least one other of said segments being formed for receiving said weight means.

22. A spindle frame according to claim 21 and characterized further in that said at least one segment for receiving magnet means is in the form of a recess.

23. A spindle frame according to claim 1 and characterized further in that said support plate is mounted to the machine frame stand independent of the mounting on the machine frame of means for driving the spindle assemblies.

24. A spindle frame for supporting a plurality of spindle assemblies in multi-spindle double twist twisting machines of the type having vertical frame stands at the ends of sections of the machine and a belt drive assembly for rotating said spindle assemblies, said spindle frame comprising a support plate formed for mounting spindle assemblies thereon, at least one row of spindle assembly mounting means on said plate for mounting spindle assemblies thereon with whorl portions of said spindle assemblies projecting in freestanding arrangement from one side of said plate and yarn supporting portions of said spindle assemblies projecting in freestanding arrangement from the other side of said plate, said support plate having longitudinal ends for mounting of said plate in the vertical frame stands at the ends of a machine section as a self-supporting sub-frame mountable alternatively in either a machine of the type in which the spindle assemblies are disposed with their axes vertical or a machine of the type in which the spindle assemblies are disposed with their axes horizontal, said belt drive assembly including a longitudinally extending beam secured at its ends to said vertical frame stands and disposed adjacent the side of said support plate from which said whorl portions project, said beam being aligned with said row of spindle assembly mounting means and being mounted to said machine frame independent of the mounting of said support plate, drive belt guiding elements supported on said beam adjacent said projecting whorl portions, a drive belt guided and supported on said elements in driving engagement with said whorl portions, and means for driving said belt.

25. A spindle frame and a belt drive assembly accordin to claim 24 and characterized further in that said support plate has two longitudinally extending rows of spindle assembly mounting means disposed on opposite sides of the longitudinal center line of said support plate, and said beam is disposed along the center line of said support plate with said beam and said belt guiding elements being disposed between said rows of spindle assembly mounting means.

26. A spindle frame for supporting a plurality of spindle assemblies in multi-spindle double twist twisting machines, said spindle frame having means for mounting spindle assemblies in two longitudinally extending rows with yarn supporting portions of said spindle assemblies projecting from one side of said spindle frame, and a separator wall projecting between said rows of spindle assemblies for separation thereof, said separator wall being extendable in the direction of projection of the yarn supporting portions of said spindle assemblies.

27. A spindle frame according to claim 26 and characterized further in that said separator wall comprises a stationary inner base portion and an outer adjustable portion mounted on said inner base portion for adjustable positioning with respect thereto for adjustment of the extent of said separator wall.

28. A spindle frame according to claim 27 and characterized further in that said inner and outer portions of said separator wall are disposed in telescoping relation for extension of said separator wall.

29. A spindle frame according to claim 26 and characterized further by ballooning yarn guides mounted on said separator wall for extendable adjustment therewith and projecting therefrom beyond said spindle assemblies for guiding therethrough yarn ballooning from said spindle assemblies.

30. A spindle frame according to claim 26 and characterized further by means for adjustably extending said separator wall comprising at least one stationary threaded sleeve projecting between said rows of spindle assemblies, an outer wall portion, and a threaded rod secured to said outer wall portion and threadably engaged in said sleeve for threadable extension of said rod and outer wall portion with respect to said spindle frame.

31. A spindle frame according to claim 27 and characterized further by means for adjustably extending said separator wall comprising at least one stationary threaded sleeve projecting between said rows within said stationary inner base portion, and a threaded rod secured to said outer wall portion and threadably engaged in said sleeve for threadable extension of said rod and outer wall portion with respect to said spindle frame.

32. A spindle frame for supporting a plurality of spindle assemblies with their axes vertical in multi-spindle double twist twisting machines, said spindle frame comprising a support plate formed for mounting spindle assemblies thereon, means on said support plate for mounting spindle assemblies in two rows extending on opposite sides of the center line of the machine, said spindle assembly mounting means being equally spaced in both rows and the spindle mounting means in one row being staggered longitudinally with respect to the spindle assembly mounting means in the other row at a spacing of approximately one half the spacing between the centers of spindle assemblies.

33. A spindle frame according to claim 32 and characterized further in that the spindle mounting means in each row are arranged in each section of the machine to provide a spacing between one end of each row and the end of said section greater by approximately one half of the space between the centers of spindle assemblies in the row than the spacing between the other end of the row from the other end of said section.

34. A spindle frame according to claim 33 and characterized further in that each longitudinal section of the machine includes on each side thereof a receiver for temporary storing of spindle assembly heads removed from spindle assemblies, said receiver being mounted on said support plate in the space provided by said spacing and the width of each said receiver being equivalent to approximately one half the spacing between the centers of spindle assemblies in the row, and the receivers on opposite sides of the spindle frame being at opposite ends of the section.

35. A spindle frame according to claim 32 and characterized further by a separator wall mounted on said support plate and projecting between said rows of spindle mounting means, said separator wall being extendable between said rows of spindle mounting means, and ballooning yarn guides mounted on said separator wall for extendable adjustment therewith and projecting therefrom beyond said spindle assemblies for guiding therethrough yarn ballooning from said spindle assemblies, said guides being disposed at spacings equivalent to one half the spacing between spindle assembly centers to provide guides for each spindle mounting means in said staggered rows.

* * * * *